US008736154B2

(12) United States Patent
Suzuki et al.

(10) Patent No.: US 8,736,154 B2
(45) Date of Patent: May 27, 2014

(54) SPARK PLUG

(75) Inventors: Akira Suzuki, Nagoya (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 63 days.

(21) Appl. No.: 13/395,257

(22) PCT Filed: Aug. 4, 2010

(86) PCT No.: PCT/JP2010/004900
§ 371 (c)(1),
(2), (4) Date: Mar. 9, 2012

(87) PCT Pub. No.: WO2011/030503
PCT Pub. Date: Mar. 17, 2011

(65) Prior Publication Data

US 2012/0176019 A1 Jul. 12, 2012

(30) Foreign Application Priority Data

Sep. 11, 2009 (JP) ..... 2009-209891

(51) Int. Cl.
*H01T 13/39* (2006.01)
*H01T 21/02* (2006.01)

(52) U.S. Cl.
USPC ..... 313/141; 313/142; 313/143; 445/7

(58) Field of Classification Search
CPC ..... H01T 13/39; H01T 21/02; H01T 13/32
USPC ..... 313/141–145; 445/7
See application file for complete search history.

(56) References Cited

U.S. PATENT DOCUMENTS 4,581,558 A * 4/1986 Takamura et al. ..... 313/141
5,488,262 A * 1/1996 Takamura ..... 313/141

(Continued)

FOREIGN PATENT DOCUMENTS

EP 0546562 A2 6/1993
EP 1976082 A2 10/2008

(Continued)

OTHER PUBLICATIONS

International Search Report (PCT/ISA/210), issued by the International Searching Authority in corresponding International Application No. PCT/JP2010/004900 on Oct. 19, 2010.

(Continued)

*Primary Examiner* — Anh Mai
*Assistant Examiner* — Elmito Breval
(74) *Attorney, Agent, or Firm* — Sughrue Mion, PLLC

(57) ABSTRACT

Problem is to enhance the welding strength when a projecting shape section is resistance-welded to a around electrode. A ground electrode 30 includes a ground electrode base material 35 and a projecting shape section 36. The projecting shape section 36 is connected by resistance welding to an opposite surface 32 of the ground electrode 30 so as to be opposite and project towards the leading end of a center electrode 20. The ground electrode base material 35 and the projecting shape section 36 are formed from a material that is composed of the same metal (for example, nickel) as a main component and have a relation of formulas (1) and (2) described below. In formula (1), the specific resistance of the ground electrode base material 35 is R (μΩcm) and the specific resistance of the projecting shape section 36 is S (μΩcm). The specific resistance R>the specific resistance S . . . (formula 1), the specific resistance R−specific resistance S≥20 . . . (formula 2). Accordingly, fusion of the ground electrode base material 35 that has a larger volume than that of the projecting shape section 36 can be expedited and the welding strength can be enhanced.

12 Claims, 6 Drawing Sheets

(56) References Cited

U.S. PATENT DOCUMENTS

| | | | | |
|---|---|---|---|---|
| 6,304,022 | B1 | 10/2001 | Matsutani | |
| 2003/0155849 | A1 | 8/2003 | Hori | |
| 2005/0174025 | A1 | 8/2005 | Okamoto | |
| 2008/0238282 | A1 * | 10/2008 | Kato et al. | 313/142 |
| 2010/0289398 | A1 | 11/2010 | Kato et al. | |

FOREIGN PATENT DOCUMENTS

| | | | |
|---|---|---|---|
| JP | 6-229551 | A | 8/1994 |
| JP | 8-298178 | A | 11/1996 |
| JP | 11-204233 | A | 7/1999 |
| JP | 2001-060488 | A | 3/2001 |
| JP | 2003-317896 | A | 11/2003 |
| JP | 2004-134209 | A | 4/2004 |
| JP | 2008-243713 | A | 10/2008 |

OTHER PUBLICATIONS

Extended European Search Report issued on Oct. 30, 2013 from the European Patent Office in a European Application No. 10815104.4.

* cited by examiner

FIG. 1

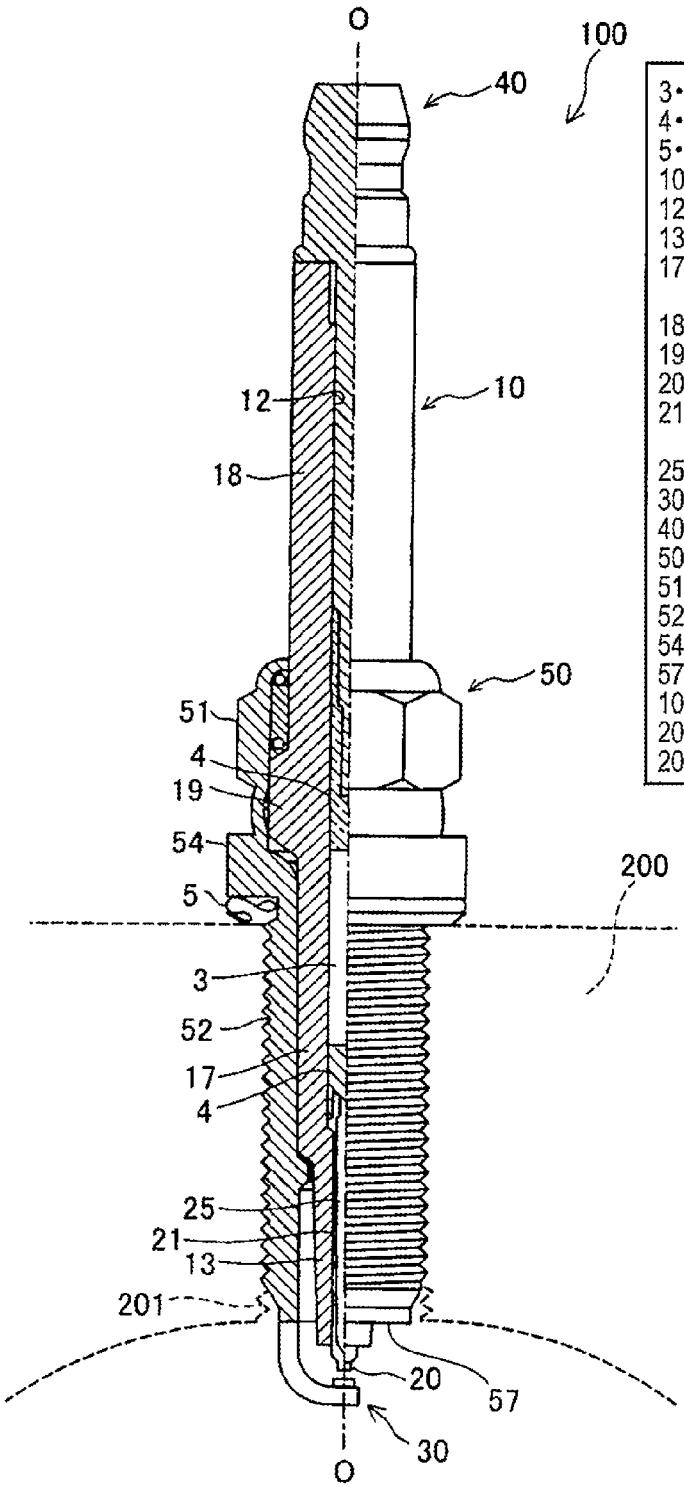

3•••CERAMIC RESISTANCE
4•••SEAL BODY
5•••GASKET
10•••INSULATOR
12•••AXIAL HOLE
13•••FOOT SECTION
17•••LEADING END SIDE BODY SECTION
18•••REAR END SIDE BODY SECTION
19•••FLANGE SECTION
20•••CENTER ELECTRODE
21•••CENTER ELECTRODE BASE MATERIAL
25•••CORE MATERIAL
30•••GROUND ELECTRODE
40•••TERMINAL METAL FITTING
50•••METAL SHELL
51•••TOOL ENGAGING SECTION
52•••ATTACHING SCREW SECTION
54•••SEAL SECTION
57•••LEADING END SURFACE
100•••SPARK PLUG
200•••ENGINE HEAD
201•••ATTACHING SCREW HOLE

FIG. 6
(a)
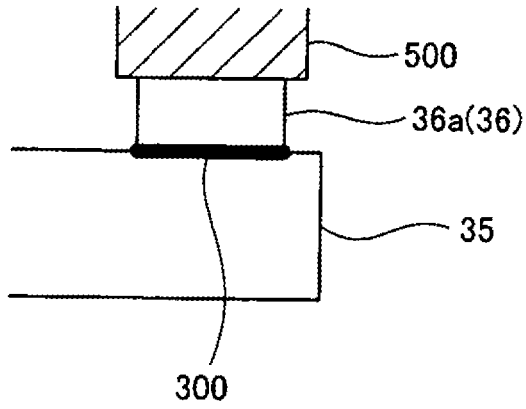
(b)
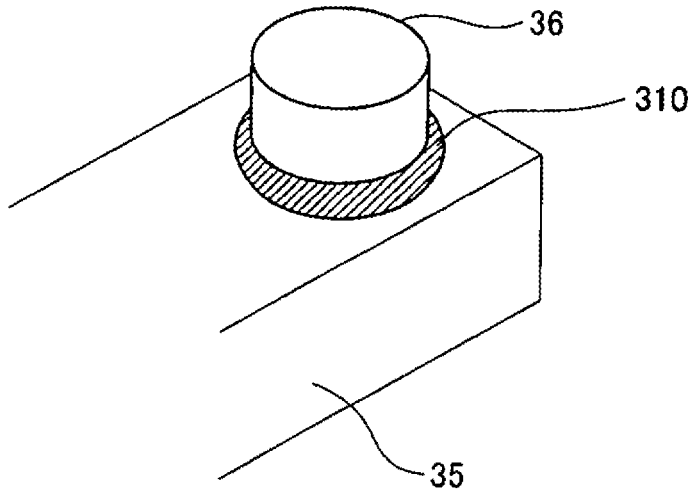

SPARK PLUG

TECHNICAL FIELD

The present invention relates to a spark plug (ignition plug) that electrically generates a spark so as to ignite to a fuel in an internal combustion engine, and specifically to a ground electrode of the spark plug.

BACKGROUND ART

Good ignition is preferable in a spark plug and for example, a technique is suggested that a ground electrode that has a projected portion being opposite to a center electrode so that the spreading of a frame improves and ignition ability is enhanced. In the spark plug of the suggested technique, a noble metal is resistance-welded to the ground electrode and the projected portion is formed so that ignition ability is enhanced.

RELATED ART DOCUMENT

[Patent document 1] Japanese Patent Publication No. 2003-317896-A

[Patent document 2] Japanese Patent Publication No. 2008-243713-A

SUMMARY OF INVENTION

Problem that the Invention is to solve

Since a noble metal is costly, a technique is suggested in which a low cost alloy that is the same type of cheap alloy (for example, nickel) that forms the base material of the ground electrode is resistance-welded to the ground electrode and the projected portion is formed. However, in a case where the base material of the ground electrode and the projected portion are the same metal, since there is no difference in the fusion point of the respective materials, the rate of temperature increase of the base material that has a large volume is slow compared to the rate of temperature increase of the projected portion that has a small volume. As a result, fusion of the base material is slow compared with the projected portion and there is a problem that the welding strength is not sufficiently high.

The invention is designed to solve the above-described problem and has an object to enhance welding strength when the projected portion is resistance-welded to the ground electrode.

Means for Solving the Problem

The invention is designed to solve at least a portion of the above-described problem and can be realized by the below described embodiments or applications.

[Aspect 1]

A spark plug comprising: a center electrode that extends in an axial direction; an insulation body that exposes a leading end of the center electrode and is formed at an outer periphery of the center electrode; a metal shell that is formed at an outer periphery of the insulation body, and a ground electrode that is welded to the metal shell, wherein the ground electrode has: a base material that is arranged so that a leading end portion thereof is opposite to an end surface of the center electrode; and a projecting shape section that is provided at the leading end portion thereof and is formed in a projected shape at a portion close to the center electrode, wherein the base material and the projecting shape section are formed by a material of the same metal as a main component and are connected by resistance welding, and wherein the base material and the projecting shape section are formed to satisfy a relation R>S when a specific resistance of the base material is R (μΩcm) and a specific resistance of the projecting shape section is S (μΩcm).

[Aspect 2]

In the spark plug according to the aspect 1, the base material and the projecting shape section are formed from a material composed of nickel as a main component.

[Aspect 3]

In the spark plug according to the aspect 1 or 2, the base material and the projecting shape section are formed so as to satisfy a relation R−S≥20.

[Aspect 4]

In the spark plug according to any one of the aspects 1 to 3, an area of welded portion between the leading end portion and the projecting shape section is 1.1 $mm^2$ or more.

[Aspect 5]

In the spark plug according to any one of the aspects 1 to 4, a noble metal alloy is welded at the leading end of the projecting shape section.

[Aspect 6]

In the spark plug according to any one of the aspects 1 to 5, a boundary portion to the base material in the outer periphery of the projecting shape section is laser welded.

[Aspect 7]

A method of manufacturing a spark plug including: a center electrode that extends in an axial direction, an insulation body that exposes a leading end of the center electrode and is formed at an outer periphery of the center electrode, a ground electrode that is connected to the metal shell and has a base material that is arranged so that a leading end portion thereof is opposite to an end surface of the center electrode and a projecting shape section that is provided at the leading end portion thereof and is formed in a projected shape at a portion close to the center electrode, the method comprising: forming a member so as to have a specific resistance smaller than that of the base material using a material that has the same metal as the base material as a main component; and resistance-welding the member to the portion of the leading end portion close to the center electrode.

[Aspect 8]

In the method of manufacturing of the spark plug according to the aspect 7, the resistance-welding the member to the portion of the leading end portion close to the center electrode is performed after welding a noble metal alloy to the leading end of the member.

In the invention, the various embodiments described above may be appropriately applied assembled together or with some portion omitted.

Advantageous Effects of Invention

According to the spark plug of the aspect 1, the base material and the projecting shape section of the ground electrode that are formed from the material of the same metal as a main component are formed so as to be (the specific resistance R of the base material>(the specific resistance S of the projecting shape section). Accordingly, the fusion of the base material that has a larger volume than that of the projecting shape section can be expedited and the welding strength can be enhanced.

According to the spark plug of the aspect 2, the base material and the projecting shape section can be formed with low cost nickel as a main component. Thus, the cost can be decreased.

According to the spark plug of the aspect 3, (the specific resistance R of the base material)−(the specific resistance S of the projecting shape section)≥20 so that the welding strength can be sufficiently enhanced.

According to the spark plug of the aspect 4, even though the area of the leading end portion of the ground electrode and the welded portion of the projecting shape section is 1.1 $mm^2$ or more, R−S≥20 so that the welding strength can be enhanced.

According to the spark plug of the aspect 5, the noble metal alloy is welded to the leading end of the projecting shape section. Accordingly, durability can be enhanced at a lower cost compared to the case where all of the projecting shape section is formed of noble metal.

According to the spark plug of the aspect 6, the base material and the projecting shape section are resistance-welded and then laser welded at the outer periphery boundary portion. Accordingly, the welding strength between the base material and the projecting shape section can be further enhanced.

According to the method of manufacturing of the spark plug of the aspect 7, the member that is formed so as to have the specific resistance smaller than that of the base material using the material that has the same metal as the base material as a main component, is resistance-welded to the portion of the leading end portion close to the center electrode. Accordingly, the fusion of the base material that has a larger volume compared to the member can be expedited and the welding strength can be enhanced.

According to the method of the manufacturing the spark plug of the aspect 8, the spark plug that has enhanced durability can be manufactured at a lower cost compared to the case where all of the projecting shape section is formed with noble metal.

BRIEF DESCRIPTION OF DRAWINGS

FIG. 1 is an explanation view mainly illustrating a cross-section portion of a spark plug 100 according to a first embodiment.

FIG. 6 is an explanation view illustrating the welding of the ground electrode base material 35 and the projecting shape section 36 according to the first embodiment.

DESCRIPTION OF EMBODIMENTS

Figure 2:
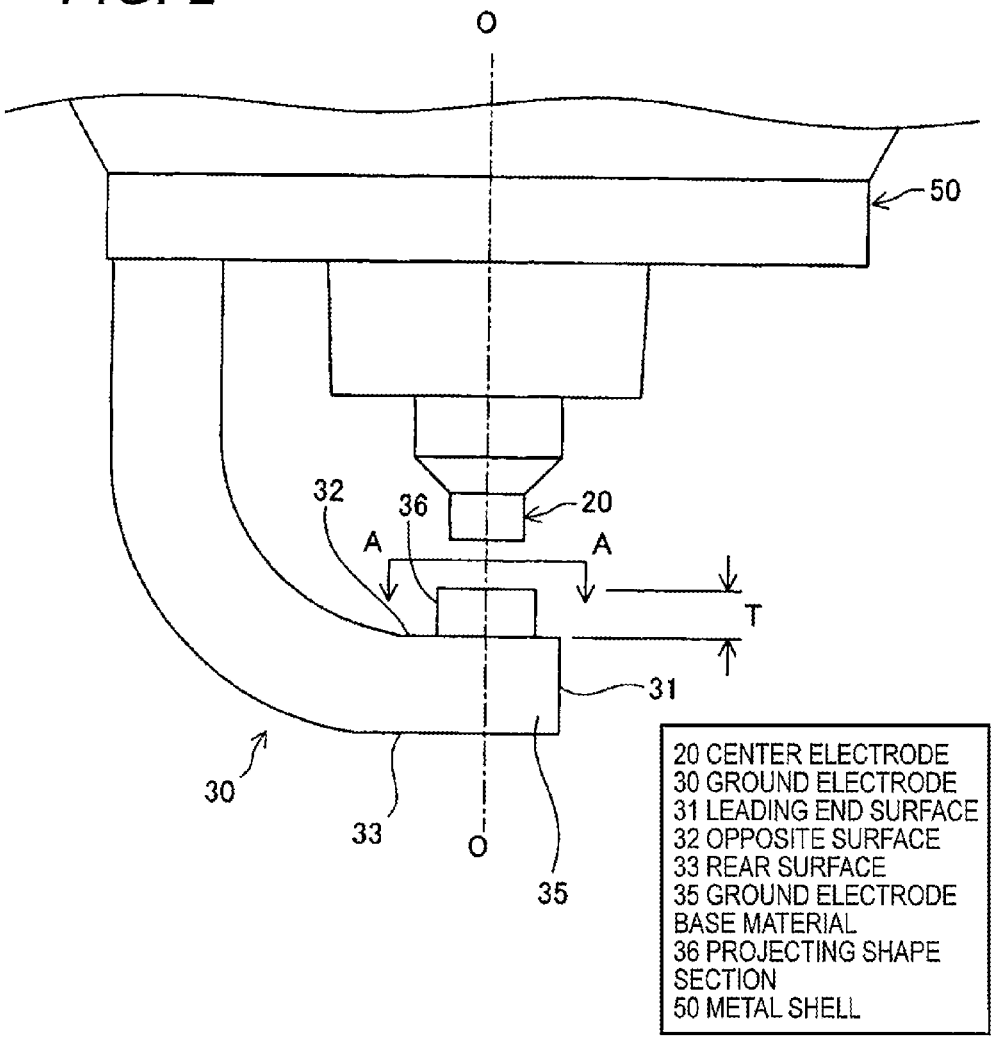
FIG. 2 is an explanation view mainly illustrating a detailed structure of a ground electrode 30 according to the first embodiment.

A. Embodiment: A 1. The configuration of the spark plug: FIG. 1 is an explanation view mainly illustrating a cross-section portion of a spark plug 100. The spark plug 100 includes an insulator 10, a center electrode 20, a ground electrode 30, a terminal metal fitting 40 and a metal shell 50. The rod shaped center electrode 20 that is projected from one end of the insulator 10 is electrically connected to the terminal metal fitting 40 that is provided at the other end of the insulator 10 through the inside of the insulator 10. The outer periphery of the center electrode 20 is insulated by the insulator 10 and the outer periphery of the insulator 10 is held by the metal shell 50 at a position that is distant from the terminal metal fitting 40. The ground electrode 30 that is electrically connected to the metal shell 50 forms a spark gap that is a gap that generates a spark between the ground electrode 30 and the leading end of the center electrode 20. The spark plug 100 is attached at a screw hole 201 that is provided on an engine head 200 of the internal combustion engine (not shown) through the metal shell 50, and when a high voltage of 20000 to 30000 volts is applied to the terminal metal fitting 40, the spark is generated at the gap that is formed between the center electrode 20 and the ground electrode 30.

The insulator 10 of the spark plug 100 is an insulation body that is formed from burnt ceramic material including alumina. The insulator 10 is a cylindrical body in which an axial hole 12 that accommodates the center electrode 20 and the terminal metal fitting 40 is formed in the center. A flange section 19 of which the external diameter is large is formed at the center of the shaft direction of the insulator 10. The rear end side body section 18 that insulates the terminal metal fitting 40 and the metal shell 50 is formed in the terminal metal fitting 40 sides rather than the flange section 19. A leading end side body section 17 which has a smaller external diameter than the rear end side body section 18 is formed in the center electrode 20 side rather than the flange section 19. A foot section 13 of which the external diameter is smaller than the leading end side body section 17 and the external diameter is decreased toward the leading end side is foil led at the further leading end of the leading end side body section 17.

The metal shell 50 of the spark plug 100 is a cylindrical body shape metal fitting that surrounds and holds a portion through the foot section 13 from a part of the rear end side body section 18 of the insulator 10 and in the embodiment the metal shell 50 is configured of low carbon steel. The metal shell 50 includes a tool engaging section 51, an attaching screw section 52, a seal section 54 and a leading end surface 57. The tool engaging section 51 of the metal shell 50 engages a tool (not shown) that attaches the spark plug 100 to the engine head 200. The attaching screw section 52 of the metal shell 50 has a thread of a screw that is engaged to a attaching screw hole 201 of the engine head 200. The seal section 54 of the metal shell 50 is formed in a circular shape at the base of the attaching screw section 52 and a circular gasket 5 that is formed by bending a plate is inserted between the seal section 54 and the engine head 200. The leading end surface 57 of the metal shell 50 is a hollow circular shape surface that is formed at the leading end of the attaching screw section 52 and the center electrode 20 that is surrounded by the foot section 13 is projected at the center of the leading end surface 57.

The center electrode 20 of the spark plug 100 is a rod shaped electrode in which a core material 25 that has a superior heat conductivity than the center electrode base material 21 is embedded at the inside of the center electrode base material 21 that is formed in a cylindrical shape having a bottom. In the embodiment, the center electrode base material 21 is composed of nickel alloy including nickel as a main component such as Inconel (registered trade mark) and the core material 25 is includes copper or alloy including copper as a main component. The center electrode 20 is inserted into the axial hole 12 of the insulator 10 in a state such that the leading end of the center electrode base material 21 is projected from the axial hole 12 of the insulator 10 and the center electrode 20 is electrically connected to the terminal metal fitting 40 through the ceramic resistance 3 and the seal body 4.

The ground electrode 30 of the spark plug 100 is an electrode that faces the leading end of the center electrode 20 that is connected to the leading end surface 57 of the metal shell 50 and is bent orthogonal to the axial direction of the center electrode 20. In the embodiment, the ground electrode 30 is composed of nickel alloy including nickel as a main component such as Inconel (registered trade mark).

FIG. 2 is an explanation view mainly illustrating a detailed structure of a ground electrode 30 according to the first embodiment. The ground electrode 30 is configured of the ground electrode base material 35 and the projecting shape section 36 and includes a leading end surface 31 that configures the leading end of the ground electrode base material 35, the opposite surface 32 that is opposite to the center electrode 20 in the surfaces of the ground electrode 30 and a rear surface 33 that is opposite to the opposite surface 32 and of which the rear is directed towards the ground electrode 30. The projecting shape section 36 is connected to the opposite surface 32 of the ground electrode 30 by the resistance-welding so as to be opposite and project to the leading end of the center electrode 20. The ground electrode base material 35 and the projecting shape section 36 are formed from a material including the same metal (nickel in the first embodiment) as a main component and has a relation of a formula 1 and a formula 2 as illustrated in below. However, in formula 1, the specific resistance of the ground electrode base material 35 is R (μΩcm) and the specific resistance of the projecting shape section 36 is S (μΩcm). In the first embodiment, the ground electrode base material 35 is corresponding to "base material" in the claims.

$$\text{Specific resistance } R > \text{specific resistance } S \quad \text{(formula 1)},$$

$$\text{Specific resistance } R - \text{specific resistance } S \geq 20 \quad \text{(formula 2)}$$

As shown in FIG. 2, a gap is formed between the projecting shape section 36 and the center electrode 20 referred to as a spark gap. The center of gravity of the projecting shape section 36 is positioned on an extended line substantially along the center shaft of the center electrode 20. In the embodiment, the projecting shape section 36 is a circular column shape projection having a circular cross section in which the height T from the opposite surface 32 is 0.3 mm or more.

Figure 3:
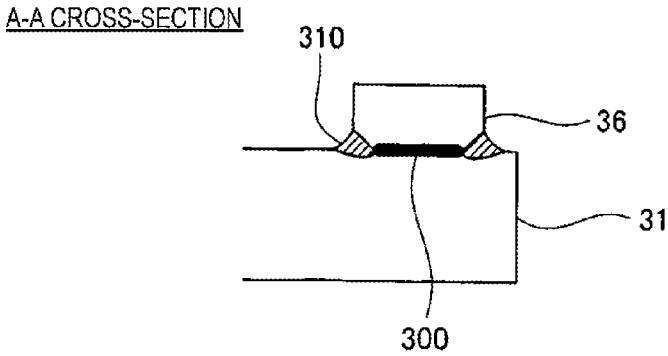
FIG. 3 is a cross-sectional view illustrating A-A cross-section in FIG. 2.

FIG. 3 is a cross-sectional view illustrating A-A cross-section in FIG. 2. In FIG. 3, a resistance-welding section 300 illustrates the welding portion that is formed by the resistance welding and a laser welding section 310 illustrates the welding portion that is formed by the laser welding. The projecting shape section 36 and the ground electrode base material 35 are welded by resistance welding and a boundary portion with the ground electrode base material 35 at the outer periphery surface of the projecting shape section 36 is welded by the laser welding.

Figure 4:
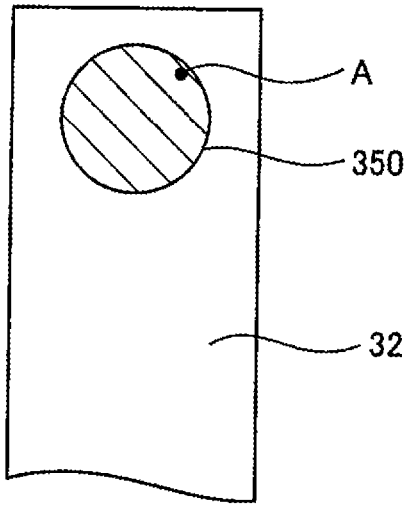
FIG. 4 is a schematic view illustrating a welded portion of a projecting shape section 36 and an opposite surface 32 according to the first embodiment.

FIG. 4 is a schematic view illustrating a welded portion of the projecting shape section 36 and the opposite surface 32 according to the first embodiment. As shown in FIG. 4, an area A (shown with hatching in FIG. 4) of a welded surface 350 between the projecting shape section 36 and the opposite surface 32 is 1.1 $mm^2$ or more. Also, in the specification, "welded portion" and "welded surface" indicates the welded portion and welded surface between the ground electrode base material 35 and the projecting shape section 36, that is formed by fusing and mixing of materials of the ground electrode base material 35 and the projecting shape section 36 or formed by diffusion at the atomic level by the resistance-welding.

Figure 5:
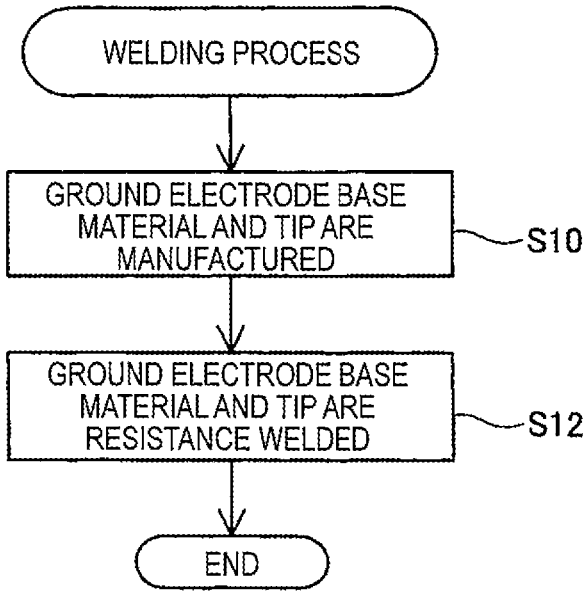
FIG. 5 is a flowchart illustrating a welding process of the projecting shape section 36 to a ground electrode base material 35 according to the first embodiment.

A2. Welding process: FIG. 5 is a flowchart illustrating a welding process of the projecting shape section 36 to the ground electrode base material 35 according to the first embodiment. FIG. 6 is an explanation view illustrating the welding of the ground electrode base material 35 and the projecting shape section 36. FIG. 6(*a*) illustrates the welding by the resistance welding and FIG. 6(*b*) illustrates the welding by the laser welding.

First, a tip that is configured of the ground electrode base material 35 and the projecting shape section 36 by a material composed of nickel as a main component is formed (step S10). Next, the ground electrode base material 35 and the tip are resistance welded (step S12). Specifically, as shown in FIG. 6(*a*), a resistance welding electrode 500 performs resistance welding in a state where the upper side end surface of the nickel tip 36*a* that becomes the projecting shape section 36 is substantially evenly pressed by a predetermined pressure. The potential of the resistance welding electrode 500 becomes a high voltage with respect to the ground potential of the ground electrode base material 35, as a result, a large current flows to the nickel tip 36*a* and the ground electrode base material 35 through the resistance welding electrode 500. Accordingly, the resistance welding section 300 is formed such that both of the lower side surface of the nickel tip 36*a* and the ground electrode base material 35 that is contacted to the lower side surface are fused and mixed, the nickel tip 36*a* is resistance welded to the ground electrode base material 35 and the projecting shape section 36 is formed. As the resistance welding electrode 500, various types known in the art such as a unit having divided type shape or recess section may be used.

Also, the projecting shape section 36 has a small volume compared to the ground electrode base material 35, however the ground electrode base material 35 and the projecting shape section 36 are formed such that the specific resistance satisfies the relation of formula 1 and formula 2, and thus a temperature increase of the ground electrode base material 35 is expedited and the ground electrode base material 35 and the projecting shape section 36 start to weld at substantially same timing. As a result, the welded material of the ground electrode base material 35 and the projecting shape section 36 are effectively mixed and the resistance welding strength between the ground electrode base material 35 and the projecting shape section 36 is enhanced.

In the first embodiment, furthermore, after the ground electrode base material 35 and the projecting shape section 36 are connected by the resistance welding, the boundary portion to the ground electrode base material 35 is welded by the laser welding in the outer periphery surface of the projecting shape section 36. Specifically, a laser is aimed at the contact surface between the projecting shape section 36 and the ground electrode base material 35 and irradiated, and the irradiation location revolves through the entire contact surface. As shown in FIG. 6(*b*), the material of the boundary portion between the ground electrode base material 35 and the projecting shape section 36 is welded and mixed, the ring shape laser welding section 310 is formed and the ground electrode base material 35 and the projecting shape section 36 are strongly connected by the laser welding.

After the ground electrode base material 35 and the projecting shape section 36 are welded by the laser welding, the ground electrode 30 is assembled to the metal shell 50 and the projecting shape section 36 is bent so as to be opposite to the center electrode 20 with a predetermined spark gap by a bending process of the leading end portion of the ground electrode base material 35. The around electrode 30 is manufactured by the process as described above and assembled to the metal shell 50.

Figure 7:
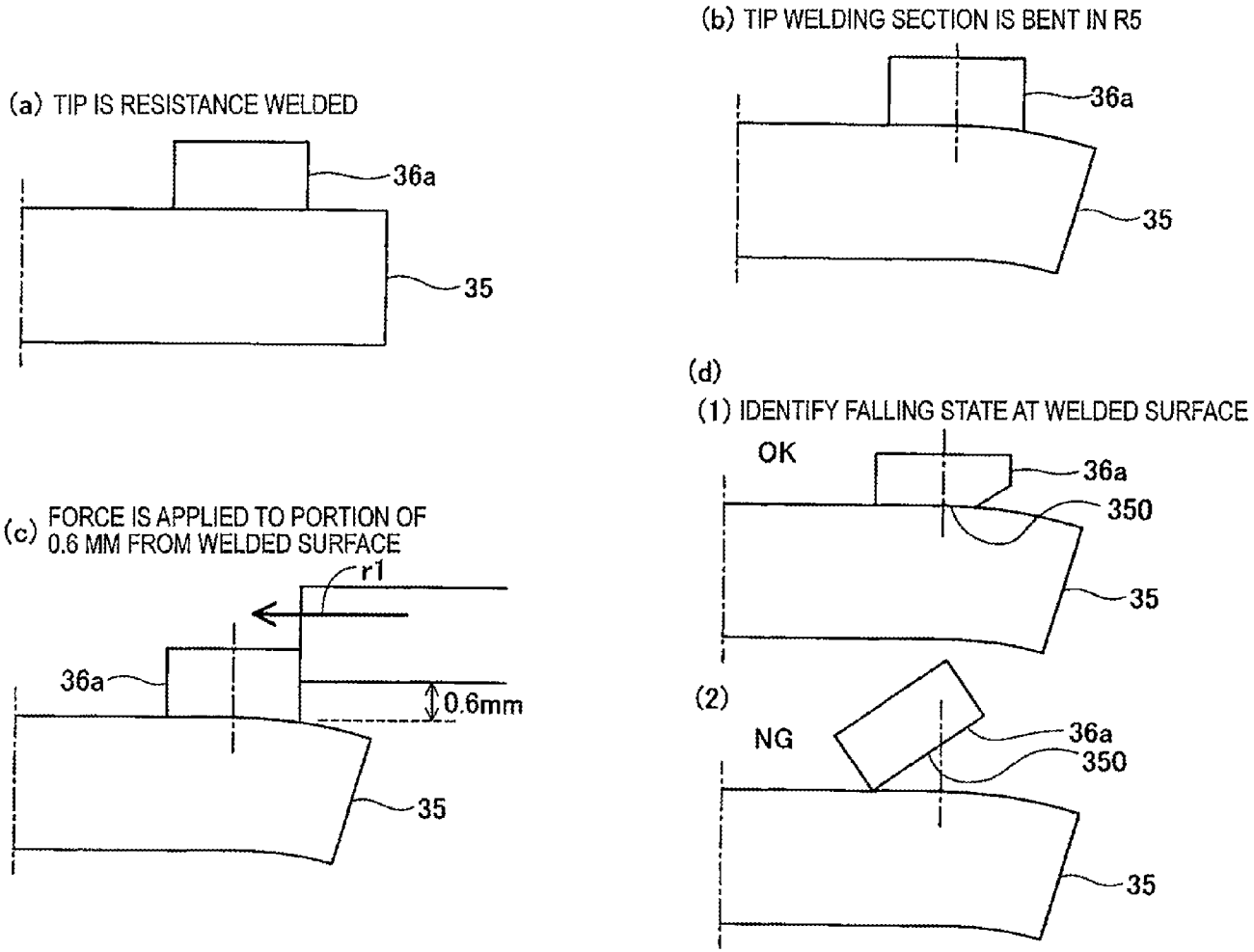
FIG. 7 is an explanation view illustrating a rupture test of the projecting shape section 36 according to the first embodiment.

A3. Test result 1 (the rupture test 1): FIG. 7 is an explanation view illustrating the rupture test of the projecting shape section 36 according to the first embodiment. Also, Table 1 is a list that illustrates component of the sample material that is used in the rupture test according to the first embodiment and Table 2 is a list that illustrates an evaluation result of the rupture test according to the first embodiment.

In the first embodiment, a rupture test 1 is performed under the conditions described below. (1) Materials (materials composed of nickel as a main component) in which each type has different specific resistance are prepared and the welding is performed using a general alternating current type of resistance welding power-source. Also, specific resistance value is measured by a four terminal measuring method using electric resistance measuring instrument for metal (TER2000RH) (manufactured by ULVAC-RIKO, Inc.). (2) The welding is performed under conditions where the welding in which the load is 200 N, welding frequency: 60 Hz, welding cycle: 10 cycles, current value is 1 kA. (3) Outside base material is used in which the width is 2.5 mm, the height is 1.4 mm, and the nickel tip that forms the projecting shape section 36 uses a circular column in which the height (length) is 1 mm and the diameter ϕ is 1 mm.

In the first embodiment, as shown in Table 1, the rupture test is performed using the sample materials of various of specific resistance value. Also, in the Table 1, Ni: nickel, Cr: chromium, Fe: iron, Si: silicon and Mn: Manganese.

TABLE 1

| Sample Material | Component (%) | | | |
|---|---|---|---|---|
| (Specific resistance value) | Ni | Cr | Fe | Others(Si, Mn) |
| 15 μΩcm | 99 | 0.5 | | 0.5 |
| 55 μΩcm | 90 | 3 | 5 | 2 |
| 75 μΩcm | 88 | 5 | 5 | 2 |
| 105 μΩcm | 74 | 16 | 9 | 1 |

For example, as shown in Table 1, the sample material in which the specific resistance is 55 μΩcm is formed from a mixed material in which nickel (Ni) is 90%, chromium (Cr) is 3%, iron (Fe) is 5% and the remainder (silicon (Si) and Manganese (Mn)) is 2%.

In the conditions as described above, as shown in FIG. 7, the nickel tip 36*a* that becomes the projecting shape section 36 is welded to the ground electrode base material 35 by the resistance welding (see FIG. 7(*a*)), and after welding, the welded surface of the ground electrode base material 35 is bent in R5 and deformed using a bending jig (see FIG. 7(*b*)). After that, a force is applied to a portion of 0.6 mm from the upper surface of the ground electrode base material 35 in a horizontal direction r1 (see FIG. 7(*c*)). As a result, as shown in FIG. 7(*d*)-(1), if falling of the welded surface 350 is less than half of the welded area, it is passed (OK) even though the top portion of the nickel tip is broken and as shown in FIG. 7(*d*)-(2), if falling of the welded surface 350 is half or more of the welded area, it is failure (NG).

In the first embodiment, evaluation is made as in 3 pattern described below according to the number of falling in thirty evaluations in regard to plurality of sample materials. For a number of 0: A, for a number of 1 to 3 (the number of falling is 10% or less of the sample number of the evaluation object): B and for a number of 4 to 30: C.

TABLE 2

| | R: Outside base material specific resistance (μΩcm) | S: Projecting shape section tip (μΩcm) | R − S | determination |
|---|---|---|---|---|
| Sample 1 | 55 | 15 | 40 | A |
| Sample 2 | 55 | 35 | 20 | A |
| Sample 3 | 55 | 40 | 15 | B |
| Sample 4 | 55 | 50 | 5 | B |
| Sample 5 | 55 | 55 | 0 | C |
| Sample 6 | 55 | 65 | −10 | C |
| Sample 7 | 55 | 75 | −20 | C |
| Sample 8 | 75 | 55 | 20 | A |
| Sample 9 | 75 | 65 | 10 | B |
| Sample 10 | 75 | 75 | 0 | C |
| Sample 11 | 75 | 105 | −30 | C |
| Sample 12 | 105 | 75 | 30 | A |
| Sample 13 | 75 | 105 | −30 | C |

As shown in Table 2, in the samples 1 to 4, 8, 9 and 12 that satisfy the relation of a formula 1 (R>S) wherein R is the specific resistance of the around electrode base material 35 and S is the specific resistance of the nickel tip 36*a* (the projecting shape section 36), the generation rate of falling becomes 10% or less and in the samples 1, 2, 8 and 12 that satisfy the formula 2 (R−S≥20), the generation rate of falling is 0. Accordingly, R that is the specific resistance of the ground electrode base material 35 and S that is the specific resistance of the nickel tip 36*a* are preferable to satisfy the relation of the formula 1 and further preferable to satisfy the relation of the formula 2.

A4. Test result 2 (rupture test 2): Table 3 is a list that illustrates the evaluation results of the rupture test 2 according to the first embodiment. In the first embodiment, the rupture test 2 is performed under conditions as described below. (1) In an assembly (sample 5) in which the specific resistance R of the ground electrode base material 35 is 55 μΩcm, the specific resistance S of the nickel tip 36*a* is 55 μΩcm and an assembly (sample 2) in which the specific resistance R of the ground electrode base material 35 is 55 μΩcm, the specific resistance S of the nickel tip is 35 μΩcm, size of the ground electrode 30 is 2.8 mm of the width and 1.5 mm of the height from the opposite surface 32, and the height (length) of the nickel tip 36*a* is fixed at 0.9 mm respectively. (2) The welding is performed under conditions where the welding in which the load is 200N welding frequency: 60 Hz, welding cycle: 10 cycles, current value is 1 kA (the same condition as the rupture test 1). (3) An area (A) of welded surface is changed from 0.5 mm to 2.5 mm.

In the first embodiment, the number of the good articles and the effect rate of thirty evaluations are evaluated regarding each of the samples. Also, in Table 3, "the number of the good articles" is a numerical value that is counted during the evaluation A and evaluation B in the above-described rupture test 1 as "good articles", and "effect rate" illustrates the ratio of the number of good articles in the sample 2 with respect to the sample 5.

TABLE 3

| Welded area(mm$^2$) | 0.5 | 0.8 | 1.1 | 1.5 | 2.0 | 2.5 |
|---|---|---|---|---|---|---|
| Number of good articles (base material 55 μΩcm projecting shape section 55 μΩcm) | 25 | 23 | 6 | 5 | 2 | 2 |

TABLE 3-continued

| | | | | | | |
|---|---|---|---|---|---|---|
| Number of good articles (base material 55 μΩcm projecting shape section 35 μΩcm) | 30 | 30 | 30 | 30 | 30 | 30 |
| Effect rate | 1.2 | 1.3 | 5.0 | 6.0 | 15.0 | 15.0 |

As shown in Table 3, if the area A of the welded portion is less than 1.1 $mm^2$, the number of the good articles is not largely different and even the effect rate is not largely different in both the samples 5 that do not satisfy the formula 1 and formula 2, and the sample 2 that satisfies the formula 1 and formula 2. Meanwhile, if the area A of the welded portion is 1.1 $mm^2$ or more, the number of the good articles is remarkably lowered in the sample 5, while the number of the good articles is thirty, in other words, all thirty samples that are evaluated and determined to be good articles in the sample 2 and thus the ratio of the effect becomes from several to several tens of times.

If the material of the projecting shape section is not a noble metal, the size of the projecting shape section 36 is preferably large in view of the enhancement of the durability, however when the welded area is large, the weldability of the center portion of the material is lowered and thus the welding strength is also lowered. According to the evaluation of the embodiment, even though the area A of the welded portion is 1.1 $mm^2$ or more, (the specific resistance R of the ground electrode base material 35)−(the specific resistance S of the projecting shape section 36)≥20 and the enhancement of the effect of the welding strength is obtained.

According to the spark plug 100 of the first embodiment as described above, the projecting shape section 36 and the ground electrode base material 35 of the ground electrode 30 that are formed from the material composed of nickel that is the same metal as a main component respectively are formed so as to satisfy the condition that (the specific resistance R of the ground electrode base material 35)>(the specific resistance S of projecting shape section). Accordingly, the fusion of the ground electrode base material 35 of which the area is larger than that of the projecting shape section 36 can be expedited and the welding strength can be enhanced. Specifically, in the first embodiment, (the specific resistance R of the ground electrode base material 35)−(the specific resistance S of the projecting shape section 36)≥20 and the welding strength can be sufficiently enhanced.

Also, according to the spark plug 100 of the first embodiment, the ground electrode base material 35 and the projecting shape section 36 can be formed from inexpensive nickel as a main component. Thus, the cost can be decreased.

Also, according to the spark plug 100 of the first embodiment, the ground electrode base material 35 and the projecting shape section 36 are resistance welded and then the laser welding is performed at the boundary portion of the outer periphery surface. Accordingly, the welding strength between the ground electrode base material 35 and the projecting shape section 36 can be further enhanced.

Figure 8:
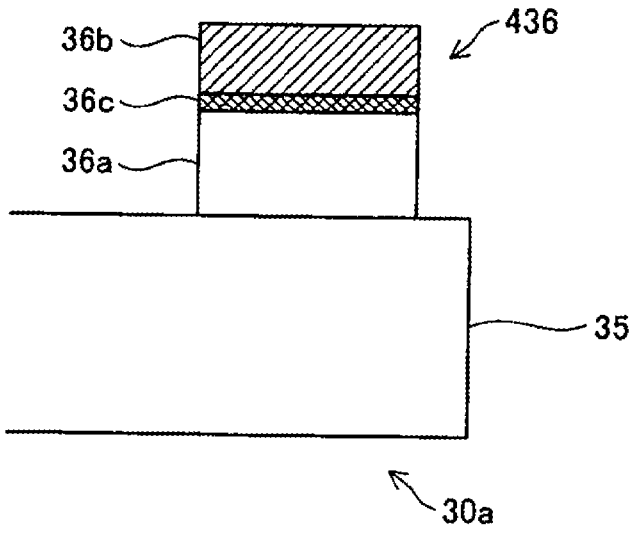
FIG. 8 is an enlarged view of a leading end section of a ground electrode 30*a* according to a modified example (1).

B. Modified example: (1) The noble metal may be welded at the end surface that is opposite to the center electrode 20 of the projecting shape section. FIG. 8 is an enlarged view of a leading end section of a ground electrode 30 according to a modified example (1). As shown in FIG. 8, a projecting shape section of the modified example is two layer-projecting shape section and the two layer-projecting shape section 436 is formed in which the nickel tip 36*a* (the nickel tip member 36*a*) that is formed of the material that has the same main component (nickel) as the ground electrode base material 35 is resistance welded and the noble metal tip 36*b* is welded on the end surface of the nickel tip 36*a* that is opposite to the center electrode 20. The welded portion 36*c* is a welded portion between the nickel tip 36*a* and the noble metal tip 36*b*. The welding method of the nickel tip 36*a* and the noble metal tip 36*b* can use various known types in the related art for example, the laser welding. Accordingly, the durability of the ground electrode 30 can be enhanced.

Figure 9:
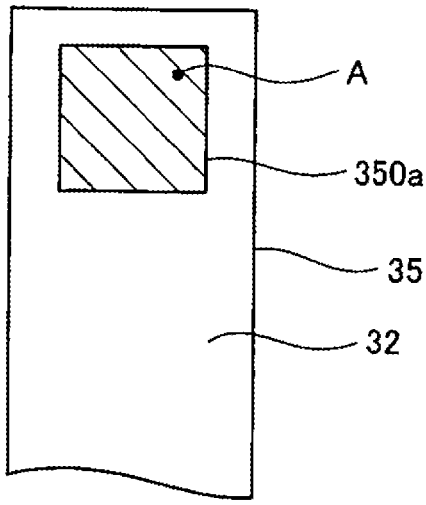
FIG. 9 is schematic view illustrating a welded surface 350*a* of the opposite surface 32 and the projecting shape section 36 according to a modified example (2).

(2) In the embodiment, the projecting shape section 36 is formed as the circular column shape projection that has a circular cross-section, however for example, it may be an angular column shape projection that has a rectangular cross section. FIG. 9 is schematic view illustrating a welded surface 350*a* of the opposite surface 32 and the projecting shape section 36 according to a modified example (2). The area A (shown as hatching in FIG. 9) of the welded surface 350*a* between the projecting shape section 36 and the leading end surface 31 is preferable to 1.1 $mm^2$ or more as the same as that of the first embodiment.

As described above, various kinds of embodiments of the invention have been described, however the invention is not limited to the embodiments and various modifications can be made without deviated from claims of the invention.

Reference Signs List

3 . . . ceramic resistance
4 . . . seal body
5 . . . gasket
10 . . . insulator
12 . . . axial hole
13 . . . foot section
17 . . . leading end side body section
18 . . . rear end side body section
19 . . . flange section
20 . . . center electrode
21 . . . center electrode base material
25 . . . core material
30 . . . ground electrode
31 . . . leading end surface
32 . . . opposite surface
33 . . . rear surface
35 . . . ground electrode base material
36 . . . projecting shape section
36*a* . . . nickel tip
36*b*. . . noble metal tip
36*c* . . . welded portion
40. . . terminal metal fitting
50. . . metal shell
51 . . . tool engaging section
52 . . . attaching screw section
54 . . . seal section
57 . . . leading end surface
100 . . . spark plug
200 . . . engine head
201 . . . attaching screw hole
300 . . . resistance welding section
310 . . . laser welding section
350 . . . welded surface
436 . . . projecting shape section
500 . . . resistance welding electrode

The invention claimed is:

1. A spark plug comprising:

a center electrode that extends in an axial direction;

an insulation body that exposes a leading end of the center electrode and is formed at an outer periphery of the center electrode;

a metal shell that is formed at an outer periphery of the insulation body, and a ground electrode that is connected to the metal shell, wherein the ground electrode has:

a base material that is arranged so that a leading end portion thereof is opposite to an end surface of the center electrode; and a projecting shape section that is provided at the leading end portion of the base material and is formed in a projected shape at a portion close to the center electrode, wherein the base material and the projecting shape section are formed by a material of the same metal as a main component and are connected by resistance welding, and wherein the base material and the projecting shape section are formed to satisfy a relation R>S when a specific resistance of the base material is R (μΩcm) and a specific resistance of the projecting shape section is S (μΩcm).

2. The spark plug according to claim 1, wherein the base material and the projecting shape section are formed from a material composed of nickel as the main component.

3. The spark plug according to claim 1, wherein the base material and the projecting shape section are formed so as to satisfy a relation R−S≥20.

4. The spark plug according to claim 1, wherein an area of welded portion between the leading end portion of the base material and the projecting shape section is 1.1 $mm^2$ or more.

5. The spark plug according to claim 1, wherein a noble metal alloy is welded at a leading end of the projecting shape section.

6. The spark plug according to claim 1, wherein a boundary portion to the base material in an outer periphery of the projecting shape section is laser-welded.

7. The spark plug according to claim 1, wherein at least one of the base material and the projecting shape includes Si or Mn.

8. A method of manufacturing a spark plug including:

a center electrode that extends in an axial direction, an insulation body that exposes a leading end of the center electrode and is formed at an outer periphery of the center electrode, a ground electrode that is connected to a metal shell and has a base material that is arranged so that a leading end portion thereof is opposite to an end surface of the center electrode and a projecting shape section that is provided at the leading end portion of the base material and is formed in a projected shape at a portion close to the center electrode, the method comprising:

forming a member so as to have a specific resistance smaller than that of the base material using a material that has the same metal as the base material as a main component; and resistance-welding the member to the portion of the leading end portion of the base material close to the center electrode.

9. The method according to claim 8, wherein the resistance-welding the member to the portion of the leading end portion of the base material close to the center electrode is performed after welding a noble metal alloy to a leading end of the member.

10. The method according to claim 8, wherein at least one of the base material and the projecting shape includes Si or Mn.

11. The method according to claim 8, wherein the base material and the projecting shape section are formed so as to satisfy a relation R−S≥20.

12. The method according to claim 8, wherein an area of welded portion between the leading end portion of the base material and the projecting shape section is 1.1 $mm^2$ or more.

* * * * *